United States Patent [19]

Rapino et al.

[11] 4,057,907

[45] Nov. 15, 1977

[54] METHOD AND APPARATUS FOR DRYING CLOTHES

[76] Inventors: Norman G. Rapino, 2220 Robinson Ave., Toledo, Ohio 43620; Frank P. DeMuro, 3324 Secor Road, Apt. No. 9, Toledo, Ohio 43606

[21] Appl. No.: 708,650

[22] Filed: July 26, 1976 (Under 37 CFR 1.47)

Related U.S. Application Data

[63] Continuation-in-part of Ser. No. 489,475, July 18, 1974, Pat. No. 3,972,126.

[51] Int. Cl.[2] ..... F26B 3/30; F26B 7/00; F26B 19/00

[52] U.S. Cl. ..... 34/4; 34/12; 34/15; 34/17; 34/60; 34/92; 34/133

[58] Field of Search ..... 34/3, 4, 12, 15, 17, 34/92, 133, 60, DIG. 14

[56] References Cited

U.S. PATENT DOCUMENTS

| | | | |
|---|---|---|---|
| 2,406,494 | 8/1946 | Ferris | 34/4 X |
| 3,175,299 | 3/1965 | Boucher | 34/DIG. 14 |
| 3,190,011 | 6/1965 | Shields | 34/133 X |
| 3,327,401 | 6/1967 | Stamos et al. | 34/17 X |
| 3,802,090 | 4/1974 | Delhaye et al. | 34/92 |
| 3,972,126 | 8/1976 | DeMuro et al. | 34/3 |

*Primary Examiner*—John J. Camby
*Attorney, Agent, or Firm*—Richard D. Emch

[57] ABSTRACT

A dryer for the rapid drying of clothing and other articles is disclosed. The dryer includes a chamber which receives the clothes or other articles. A vacuum pump reduces the air pressure within the chamber to below atmospheric. A microwave emitter directs radiant energy into the wet clothing to excite the water molecules while an ultrasonic generator is adjacent the chamber for breaking large water aggregates into smaller units.

3 Claims, 1 Drawing Figure

METHOD AND APPARATUS FOR DRYING CLOTHES

CROSS-REFERENCE TO RELATED PATENT APPLICATION

This application is a continuation-in-part of application Ser. No. 489,475, filed July 18, 1974, now U.S, Pat. No. 3,972,126.

BACKGROUND OF THE INVENTION

Various methods and apparatus have been used in the past for drying clothes and other articles found in either household or commercial laundry operations. Such other articles are, for examples, towels, sheets, laboratory coats and the like.

Many prior art apparatus, used in the drying of clothes, merely involve the heating of the clothes by various means together with the tumbling of the clothes in, for example, a rotary drum apparatus. Some prior art methods of heating involve the use of electrical resistance heating and gas burner heating, both of which were normally used when the clothes were in an ambient pressure situation.

However, other prior art drying methods included applying a vacuum to the articles being dried or the introduction of radio frequency current flow into the articles. Such a prior art method is disclosed, for example, for use in the drying of rayon thread cakes, in U.S. Pat. No. 2,325,652.

The major problem in connection with prior art methods and apparatus is the time needed to dry the damp articles.

DESCRIPTION OF THE PREFERRED EMBODIMENT

Figure 1:
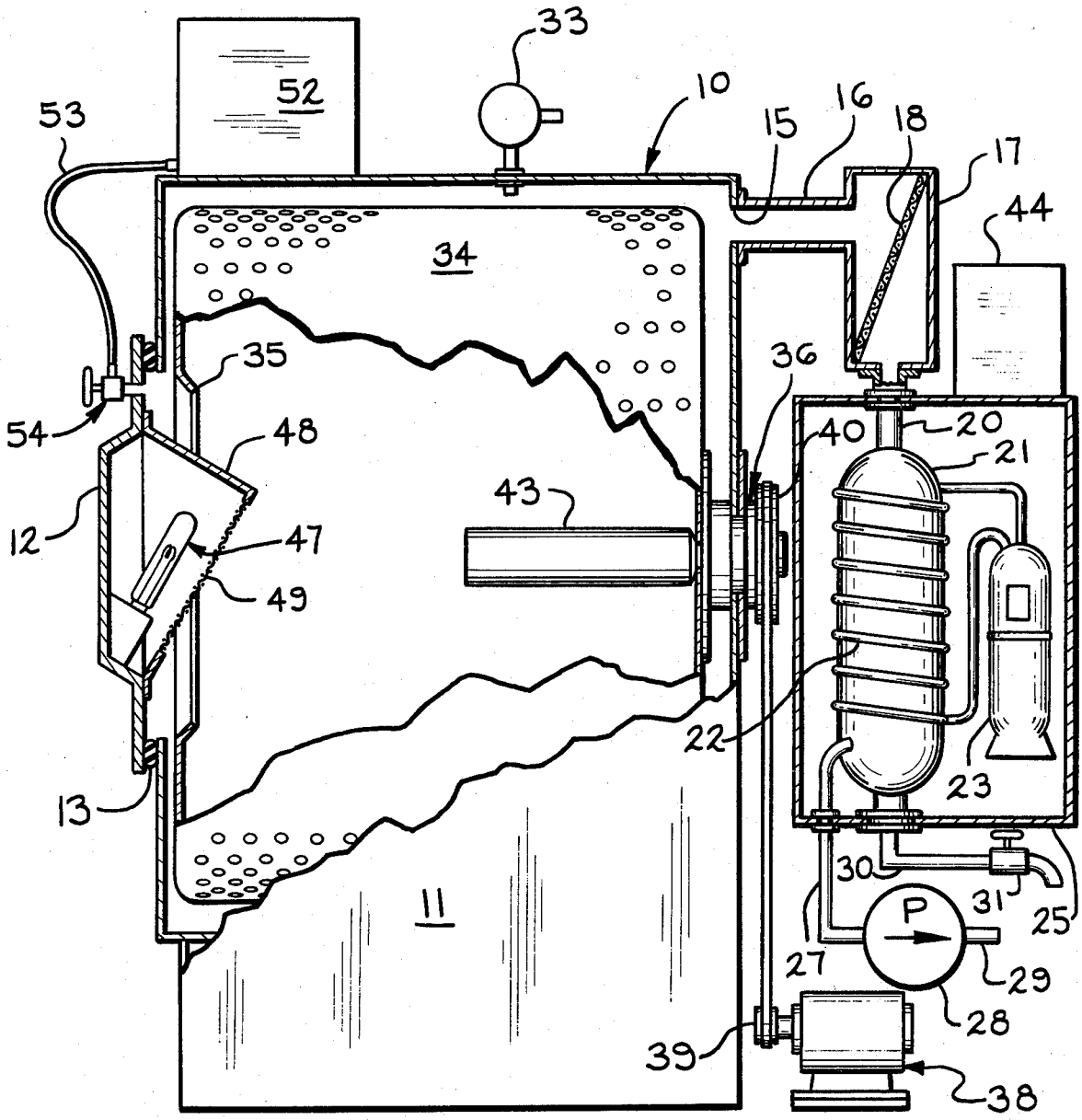
FIG. 1 is a fragmentary, diagrammatic view, partially in cross section, to show internal parts of one embodiment of a clothes dryer constructed according to the present invention.

A clothes dryer, constructed according to the present invention, is generally indicated in FIG. 1 by the reference number 10. The clothes dryer 10 is used for the rapid drying of clothes and other articles, for examples, towels, sheets, laboratory coats and similar articles. While the present embodiment is more adaptable to commercial laundry operations, including hotels, hospitals, universities and the like, other embodiments are adaptable for household use.

However, in a household unit, or other applications where metal zippers or other metal items are present within the articles to be dryed, an additional heater coil-fan circuit is provided (not shown) together with switching apparatus for deactivating the normally used micro-wave source.

The clothes dryer 10 includes a cabinet 11 having an entrance door 12. A perimeter seal 13 surrounds the door 12. The cabinet 11 defines an opening 15 which is in communication with a vacuum duct 16. The vacuum duct 16 extends between the cabinet 11 and a lint chamber 17. The lint chamber 17 includes a filter 18 and a pressure sealable port (not shown) for the removal and replacement of the filter 18. A conduit 20 extends between the lint chamber 17 and a cooling chamber 21. Coils 22 surround the cooling chamber 21 and are in communication with a compressor assembly 23. The cooling chamber 21 and the compressor assembly 23 are located within a dehumidification enclosure 25.

Other types of dehumidification apparatus may be utilized, either as an alternative to the cooling chamber 21 and the compressor assembly 23 or as a supplement. For example, desiccants including silica gel are suitable in some installations and may be placed directly within the cabinet 11 to speed the drying processes.

A conduit 27 extends from the lower portion of the cooling chamber 21 and is in communication with a vacuum pump 28. A conduit 29 extends from the vacuum pump 28 to atmosphere in this embodiment. A drain line 30 including a valve 31 extends from the lowermost portion of the cooling chamber 21 to drain condensed liquid from the cooling chamber 21.

A pressure valve 33 is mounted through the upper wall of the cabinet 11. The pressure valve 33 operates both as a safety valve and as an air supply valve. When the pressure within the sealed cabinet 11 reaches a predetermined level, the pressure valve 33 opens allowing atmospheric air to enter the cabinet 11.

In the present embodiment, a perforated drum 34 having a side opening 35 is rotably mounted by a bearing assembly 36 to the cabinet 11. A motor and gear reducer assembly 38 includes an output pulley 39 which is in alignment with a pulley 40 of the bearing assembly 36. A belt 41 extends between the pulleys 39 and 40 to rotate the drum 34.

In the present embodiment, an ultrasonic probe 43 is mounted by the bearing assembly 36 and extends inwardly within and along the axis of rotation of the drum 34. If desired, an ultrasonic generator 44 mounted on the dehumidification enclosure 25 may also be utilized. The probe 43 and the generator 44 breaks the large water aggregates or agglomerates into smaller units as the wet articles tumble within the drum 34.

A microwave unit 47, is mounted within the entrance door 12 of the cabinet 11 and directs microwaves into the drum 34. This energy excites the water molecules to aid the evaporation or drying process. The microwave unit 47 is mounted below a shield 48 and a protective screen 49 is positioned in front of the unit 47. The microwave unit 47 has an electrical disconnect to insure that the unit 47 is inoperable when the entrance door 12 is open. In addition, the entire clothes dryer 10 is shielded to prevent undesired radiation exterior of the cabinet 11.

In the present embodiment, a liquid container 52 is mounted on the top of the cabinet 11. A flexible hose 53 extends from the liquid container 52 to a valve fitting 54 mounted in the entrance door 12 of the cabinet 11. In the present embodiment, cosolvents such as low molecular weight alcohols or ethers are placed in the liquid container 52. The cosolvents are introduced into the cabinet 11 by opening the valve fitting 54. The cosolvent moves downwardly over the shield 48 directly into the drum 34.

During a typical operation of the clothes dryer 10, the entrance door 12 is opened and wet articles are placed within the drum 34. The door 12 is closed and the motor assembly 38 is actuated, together with the vacuum pump 28. The pressure within the cabinet 11 is reduced to a sub-atmospheric level. The drum 34 begins to rotate and the damp articles tumble. The ultrasonic probe 43 and ultrasonic generator 44 are actuated together with the microwave unit 47. As the damp articles tumble, the ultrasonic probe 43 breaks down large water aggregates into smaller units thus causing evaporation to proceed at a more rapid rate.

The microwave emitter, in this embodiment the unit 47, directs microwave radiation toward the wet articles. Preferably, the drum 34 is constructed of a plastic material which is transparent to microwave radiation. The microwave radiation excites the water molecules and greatly speeds evaporation. While infrared radiation may be used, it has been found that microwave radiation does a much faster, more efficient job of aiding in the evaporation of water.

The vacuum pump 28 maintains a sub-atmospheric pressure within the cabinet 11. It has been found that the combination of sub-atmospheric pressure, ultrasonic emissions and microwave radiation greatly reduces the time necessary to dry wet or damp articles.

The vacuum pump 28 pulls air through the cooling chamber 21, the lint chamber 17 and the vacuum ducting. The cooling chamber 21 removes moisture from the clothes dryer air. It has been found that such dehumidification retards the contamination of the vacuum pump 28.

The system air is also passed through the filter 18 of the lint chamber 17 prior to its passage through the cooling chamber 21. As mentioned above, a cosolvent such as a low molecular weight alcohol or ether may be introduced into the drum 34 to aid in the evaporation of water by reducing the effective concentration of water, replacing it instead with a more volatile substance. Since the use of a cosolvent introduces a more explosive mix into the clothes dryer 10 and also of necessity requires the removal of such substances from the effluent, the use of cosolvents is more adaptable to a large scale commercial operation as opposed to, for example, home use or a smaller commercial application.

The makeup air is introduced through the pressure valve 33 which, in addition, protects the clothes dryer 10 in the event that the pressure within the cabinet 11 falls below a predetermined level. The pressure valve 33 also includes a manual or automatic release to vent the system to atmosphere, for example, after the articles are dried.

It has been found that the method and apparatus for drying articles, according to the present invention, greatly reduces the time of drying as compared to a typical prior art dryer.

What we claim is:

1. A method of drying clothes comprising the steps of placing the clothes in a sub-atmospheric space, maintaining the sub-atmospheric pressure within the space, agitating the clothes, ultrasonically vibrating the clothes to break large water agglomerates into smaller units and applying microwave radiation to the clothes to excite the water molecules and speed evaporation.

2. A clothes dryer comprising, in combination, chamber means for receiving clothes to be dried, pressure reducing means in communication with said chamber means for reducing the pressure within said chamber means to below atmospheric and for maintaining the below atmospheric pressure within the space, an ultrasonic generator means adjacent said chamber means for breaking large water aggregates into smaller units and microwave means adjacent said chamber means for exciting the water molecules thereby speeding evaporation.

3. A clothes dryer comprising, in combination, a cabinet having an entrance door, said cabinet being airtight wherein a sub-atmospheric pressure may be maintained, a drum mounted for rotation within said cabinet, said drum defining an opening in communication with said entrance door whereby wet articles can be placed within said drum, motor means for rotating said drum, a vacuum pump in communication with said cabinet for reducing the pressure within said cabinet to sub-atmospheric, ultrasonic generator means adjacent said cabinet and said drum for breaking large water agglomerates into smaller units and microwave means adjacent said cabinet and said drum for exciting the water molecules thereby speeding evaporation.

* * * * *